US008366293B2

(12) United States Patent
McDermott

(10) Patent No.: US 8,366,293 B2
(45) **Date of Patent: *Feb. 5, 2013**

(54) COLOR CHANGING LIGHTING DEVICE

(76) Inventor: Damien McDermott, Rockledge, FL (US)

( * ) Notice: Subject to any disclaimer, the term of this patent is extended or adjusted under 35 U.S.C. 154(b) by 577 days.

This patent is subject to a terminal disclaimer.

(21) Appl. No.: 12/456,749

(22) Filed: Jun. 22, 2009

(65) Prior Publication Data

US 2010/0321931 A1 Dec. 23, 2010

(51) Int. Cl.
*F21V 13/00* (2006.01)
*F21L 4/00* (2006.01)

(52) U.S. Cl. ..... 362/231; 362/190; 362/249.02

(58) Field of Classification Search ..... 362/164, 362/166–168, 178, 184, 188, 197, 220, 230, 362/231, 238, 249.02, 249.03, 249.07, 249.1, 362/285, 287, 372, 800
See application file for complete search history.

(56) References Cited

U.S. PATENT DOCUMENTS 2,356,654 A * 8/1944 Cullman ..... 362/223
3,253,276 A * 5/1966 Nagel ..... 340/815.76
4,225,906 A * 9/1980 Gulliksen et al. ..... 362/254
4,386,391 A * 5/1983 Gulliksen et al. ..... 362/232
5,894,196 A * 4/1999 McDermott ..... 313/512
7,073,922 B2 * 7/2006 Monjo et al. ..... 362/232
7,293,893 B2 * 11/2007 Kim ..... 362/205
7,434,955 B2 * 10/2008 Vickers et al. ..... 362/205
7,478,918 B2 * 1/2009 Petzl et al. ..... 362/205
7,784,963 B2 * 8/2010 Galli et al. ..... 362/184
7,896,518 B2 * 3/2011 Holmes et al. ..... 362/184
2002/0149928 A1 * 10/2002 Watterson et al. ..... 362/184
2003/0067769 A1 * 4/2003 Gilpin ..... 362/184
2005/0122711 A1 * 6/2005 Matthews et al. ..... 362/184
2005/0157492 A1 * 7/2005 Chiu ..... 362/184
2006/0158892 A1 * 7/2006 Schmidt et al. ..... 362/471
2006/0256553 A1 * 11/2006 Lin ..... 362/184
2007/0153512 A1 * 7/2007 Hendrie ..... 362/231

* cited by examiner

*Primary Examiner* — John A Ward
(74) *Attorney, Agent, or Firm* — Kevin T. Price

(57) ABSTRACT

A color changing lighting device incorporating a plurality of led emitters having a plurality of colors each emitting a distinct color of light upon being energized by a power supply. A color changer having an indexing position for each led emitter for activating a related switch and connecting a power supply to the led emitter while concurrently positioning a light concentrating lens about the led emitter to concentrate the light emitted from that led emitter. The color changing lighting device therefore permitting the user to easily select light of a distinct color from a plurality of colors and have that light efficiently concentrated about the axis of the light concentrating lens.

39 Claims, 4 Drawing Sheets

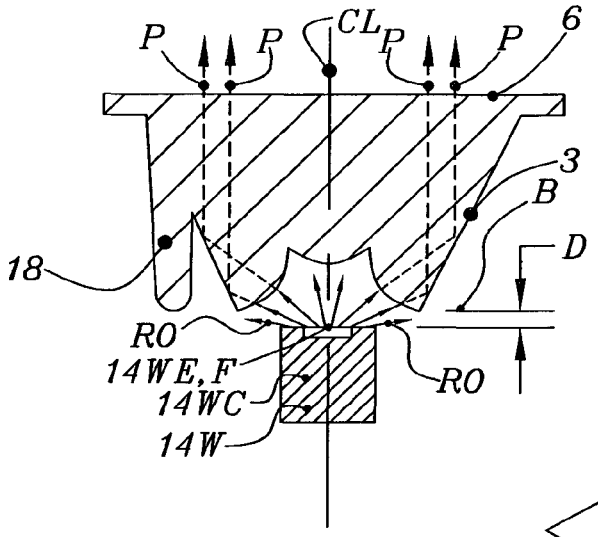
FIG 7
FIG 8
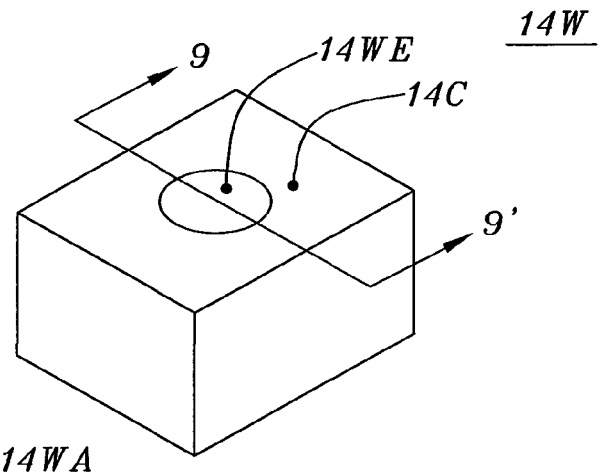
FIG 9
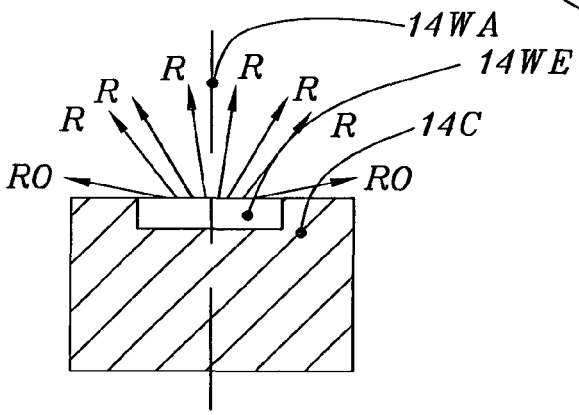
FIG 10
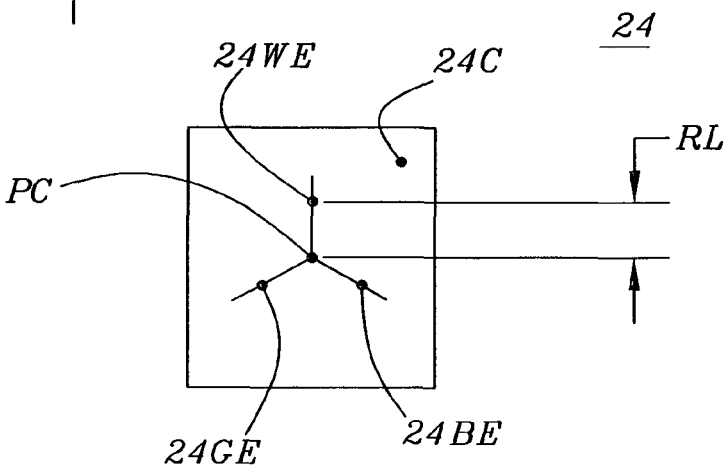

COLOR CHANGING LIGHTING DEVICE

BACKGROUND OF THE INVENTION

1. Field of the Invention

Lighting devices such as flashlights are frequently required to emit light of more than one color. These color changing lighting devices permit their operator to select any of several distinct colors of emitted light.

Color changing lighting devices are required to be efficient in creating light and efficient in concentrating the light into a desired beam pattern. Led emitters are highly efficient sources of light available in a multiplicity of colors and typically emit their light in a hemispherical pattern. Light concentrating lenses are used to condense the hemispherical light from led emitters into a concentrated light beam. Light concentrating lenses such as catadioptric lenses are well known devices employed to efficiently concentrate light into a concentrated beam.

2. Prior Art

Color changing lighting devices have in prior art included an incandescent lamp with its color changed by covering the lamp with any one of a plurality of color filters. This design is not efficient.

Led light emitters have been employed with large catadioptric lens to create efficient flashlights with high intensity concentrated light beams. In order to maximize the efficiency of the device and collect all of the light emitted by the led emitter the large catadioptric lens is made to fill the entire hemisphere above the led emitter. In these designs, the led emitters usually include a substantially spherical dome which, in order to maximize the light collected, extends into a large catadioptric lens. The large size of the catadioptric lens relative to the led emitter is desirable because this assures efficient control of the light being concentrated. These prior art led designs emit a concentrated light beam of only one color with that color determined by the color emitted by the led emitter. An efficient prior art design could be created to emit a plurality of colors, however, this would require a plurality of large catadioptric lens each with a dedicated led emitter of a different color at its focal point. The plurality of large catadioptric lenses would make the design bulky and expensive both of which are undesirable. Bulky lighting devices are more easily damaged, difficult to hold and more costly to store and ship.

- Prior art has not produced a color changing lighting device which is compact and highly efficient.
- Prior art has not produced a color changing lighting device which uses a single catadioptric lens to concentrate light of different colors emitted by a plurality of led emitters.
- Prior art positions the led emitter very close to the lens to maximize efficiency leaving no predetermined clearance for unencumbered relative lateral movement.
- Prior art does not concentrate a plurality of visually identifiable discrete colors using a single catadioptric lens.
- Prior art does not provide a switching system to energize the led when the led is at the focal or light concentrating point of the lens and to extinguish the led when it is away from the focal point.
- Prior art does not provide a color changer mechanism to move a single catadioptic lens relative to a plurality of led emitters.
- Prior art does not provide a catadioptric lens to concentrate the light from each color of a plural color led emitter.

3. Objects and Advantages

The objects and advantages of the present invention are:

- to provide a lighting device which employs a moveable color changer which can be used to select any one of a plurality of emitted colors or to select an off mode.
- to provide an efficient lighting device which is compact, can emit a plurality of colors and is less expensive to manufacture than prior art.
- to provide an efficient lighting device which can emit a plurality of colors, is easier to hold and easier to direct than prior art.
- to provide an efficient lighting device which employs a single light concentrating catadioptric lens to efficiently concentrate the light from any one of a plurality of led emitters each of a different color.
- to provide a high efficiency lighting device which permits the user to move a component such as a color changer to an indexing position and thereby activate a switch to energize a led emitter of a first color while simultaneously moving a lens to a light concentrating position about the led emitter so that the emitted light of the led emitter is efficiently concentrated into a light beam. The user can additionally move the color changer to a second indexing position and thereby activate a second switch to energize a second led emitter of a second color while simultaneously moving the lens to a light concentrating position about the second LED emitter so that its emitted light is concentrated into a light beam.
- to provide a lighting device which includes a switching means for each of a plurality of led emitters of distinct colors to energize each led emitter as it is positioned at a light concentrating point of a light concentrating catadioptric lens and to extinguish the led emitter as it is moved from the light concentrating point.
- to provide a lighting device having a light concentrating catadioptric lens at a predetermined clearance distance from each of a plurality of led emitters permitting relative lateral unencumbered movement to selectively position each led emitter at a light concentrating point of the lens.

SUMMARY

A color changing lighting device comprising a circuit having a plurality of led emitters comprising a plurality of colors. The circuit attached to a housing. Each led emitter having a distinct color. The housing moveably connected to a color changer which comprises a light concentrating optic such as a catadioptric lens. The lens having a light concentrating point and by means of the color changer a moveable relationship with the led emitters such that the light concentrating point of the lens can be positioned at each of the led emitters. The color changer selectively positions a light concentrating point, usually the focal point, of the lens at each led emitter to have the light emitted by the led emitter concentrated. The lens concentrates the light emitted by the led emitter located at its focal point towards parallelism with the axis of the lens forming an intense light beam approximately parallel with the axis of the lens. The moveable relationship between the lens and the led emitter comprises a rotational movement of the lens about a center of rotation of the color changer. The focal point of the lens is at an led radius distance from the center of rotation of the color changer. Each led emitter is also positioned at the led radius distance from the center of rotation of the color changer. The lighting device comprises an optional indexing system comprising an indexing position for each led emitter to facilitate the rotational alignment of the lens with a selected led emitter. The lighting device further includes a switching system that comprises a switch for each led emitter. Each switch energizes its related led emitter with a power supply when the led emitter is at the focal point of the lens and de-energizes it when it is away from the focal point. The switch for the led emitter is activated by a switch activator attached to the color changer. The switch activator is moved to a switch activation position for the led emitter as the color changer is moved to the indexing position of the color changer which is related to the selected led emitter.

In use a person can move the color changer to an indicator to select and energize any one of a plurality of led emitters to select the distinct color of that led emitter and to place that emitter at the focal point of a catadioptric lens where the emitted light is concentrated towards parallelism and projected from the lighting device.

DRAWINGS—FIGURES

FIG. 1 is a perspective view of lighting device 25 of the present invention FIG. 2 is FIG. 1 with color changer 1 removed FIG. 3 is a partial cross-section taken across 3-3 of FIG. 1 and rotated FIG. 4 is a top view of circuit 13 removed from FIG. 2

FIG. 7 is a diagrammatic view of cover 6, lens 3 and white led 14W removed from FIG. 3

FIG. 8 is an enlarged perspective view of white led 14W removed from FIG. 4

FIG. 9 is a cross-section of white led 14W taken across line 9-9 of FIG. 8

FIG. 10 is a top view of plural color changing led 24

Figure 1:
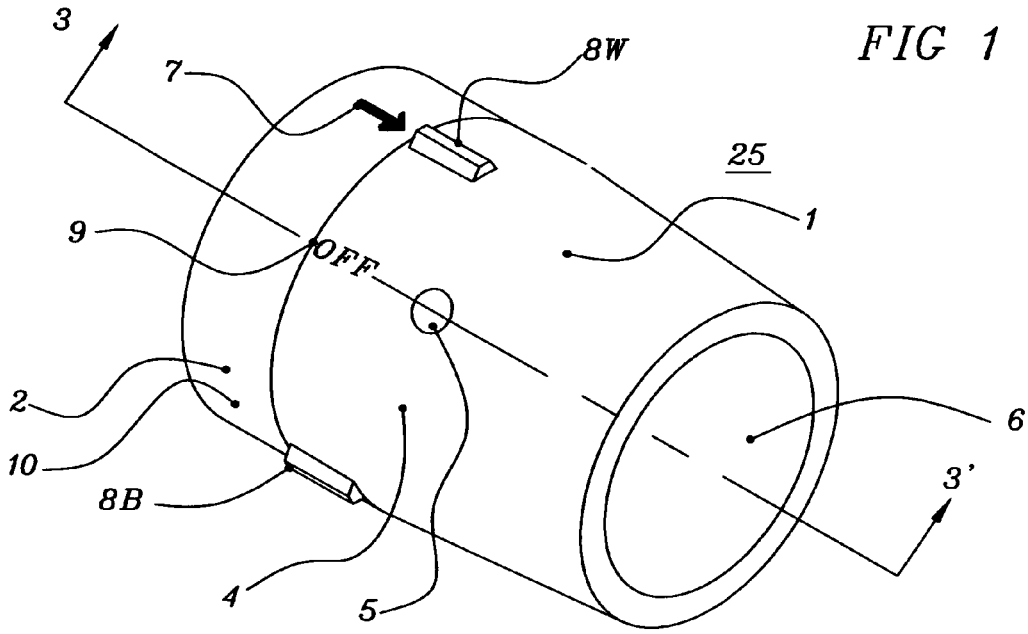

| DRAWINGS - Reference Letters | |
|---|---|
| B | Lens Base Line |
| C | Light Concentrating Point |
| CA | Switch Activator Centerline |
| CAL | Switch Activator Locus |
| CE | Emitter Centerline |
| CH | Housing Centerline |
| CL | Lens Centerline |
| CLL | Lens Centerline Locus |
| CR | Color Changer Centerline |
| D | Clearance Distance |
| F | Focal Point |
| LC | Led Circle |
| P | Projected Light Beam |
| PC | Plural LED Center |
| R | Forward Light Rays |
| RL | Led Radius |
| RO | Oblique Light Rays |
| RS | Switch Radius |
| SC | Switch Circle |
| **DRAWINGS - Reference Numerals** | |
| 1 | color changer |
| 2 | housing |
| 3 | catadioptric lens |
| 4 | shell |
| 5 | pin |
| 6 | cover |
| 7 | arrow |
| 8B | blue indicator |
| 8G | green Indictor |
| 8W | white indicator |
| 9 | off indicator |

-continued

| | |
|---|---|
| 10 | hub |
| 11 | body |
| 12 | groove |
| 13 | circuit |
| 14 | |
| 14B | blue led |
| 14BC | blue led base |
| 14BE | blue led emitter |
| 14G | green led |
| 14GC | green led base |
| 14GE | green led emitter |
| 14W | white led |
| 14WA | white led axis |
| 14WC | white led base |
| 14WE | white led emitter |
| 15 | |
| 15B | blue switch |
| 15G | green switch |
| 15W | white switch |
| 16 | power supply |
| 17 | printed circuit board |
| 18 | switch activator |
| 19 | |
| 20 | |
| 22 | |
| 21 | |
| 23 | |
| 24 | plural color led |
| 24BE | plural blue emitter |
| 24C | plural led base |
| 24GE | plural green emitter |
| 24WE | plural white emitter |
| 25 | lighting device |

OPERATIONAL DESCRIPTION OF THE PREFERRED EMBODIMENT FIGS. 1-10

Figure 2:
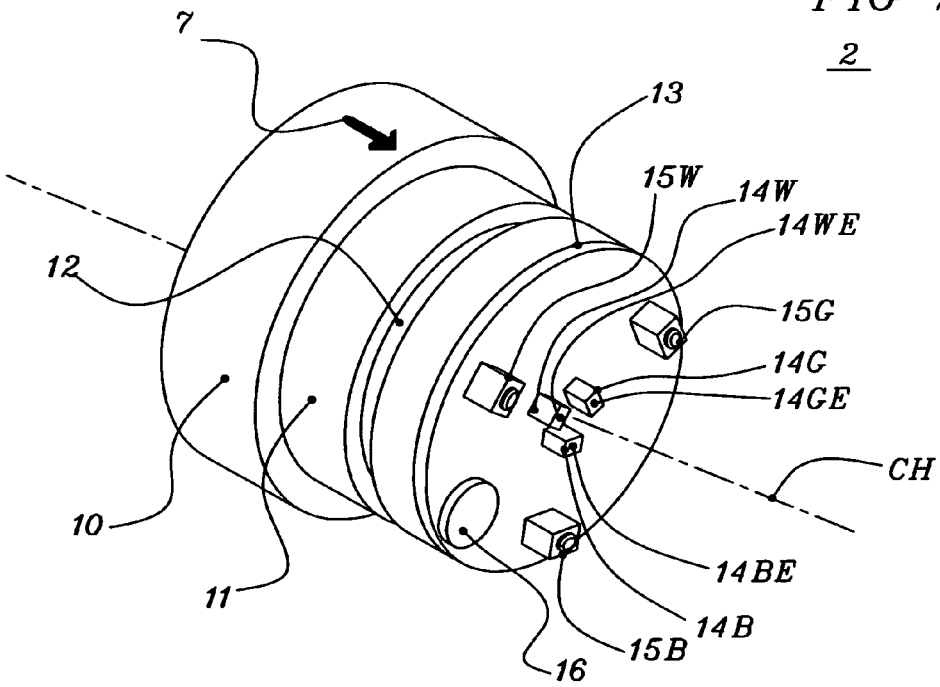
Figure 3:
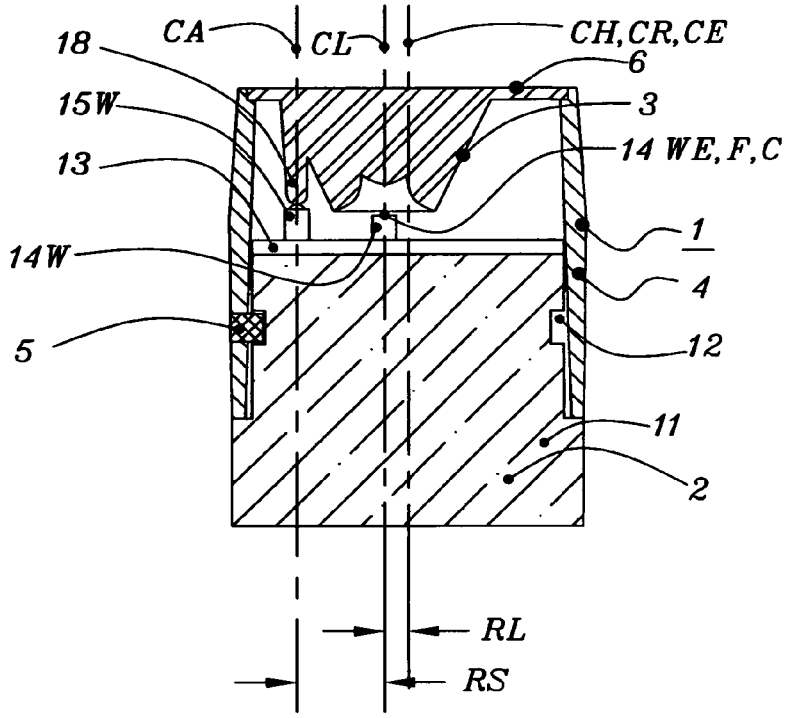

In the drawings, closely related components have the same number but different alphabetic suffixes. A preferred embodiment of the color changing lighting device of the present invention is illustrated in FIGS. 1 through 10. FIG. 1 is a perspective view of lighting device 25. FIG. 2 is color changing lighting device 25 of FIG. 1 with color changer 1 removed. FIG. 3 is a partial cross-section across line 3-3' of FIG. 1, however FIG. 3 is rotated so that cover 6 is on the top. FIG. 1 shows color changing lighting device 25 comprising color changer 1 and housing 2. FIG. 2 shows housing 2. In FIGS. 1, 2 and 3 color changer 1 comprises a light concentrating optic catadioptric lens 3 within shell 4 both usually molded of a high impact resin. Catadioptric lens 3 is designed to maximize the percentage of light emitted by the light source positioned at its focal point F. Catadioptric lens 3 employs both refraction and reflection to maximize the light collected and concentrated. Housing 2 includes hub 10, body 11, groove 12 and arrow 7 all molded as one piece. Shell 4 is placed over body 11 and comprises pin 5 pressed into a hole in shell 4 and entering groove 12 of body 11. Pin 5 is shown pressed into a hole in shell 4 however it can alternatively have a thread permitting it to be removeable from a threaded hole in shell 4. Shell 4 further includes white indicator 8W usually painted white, green indicator 8G—to be shown in FIG. 6—usually painted green and blue indicator 8B usually painted blue all of which are ribs molded as part of shell 4 and equally spaced at 120 degrees about color changer centerline CR. Shell 4 also comprises off indicator 9.

Color changer 1 is moveably attached to housing 2 and comprises a plurality of indexing positions relative to housing 2. By having pin 5 in groove 12 during assembly color changer 1 is attached to, yet can be rotated about, housing 2 without separating from housing 2. Housing 2 includes housing indicator arrow 7 which can be positioned to point to either white indicator 8W, green indicator 8G, blue indicator 8B or off indicator 9 as color changer 1 is rotated. For reasons to be later described color changing lighting device 25 will emit a concentrated white light when indictor arrow 7 is pointed towards white indicator 8W, a concentrated green light when pointed towards green indicator 8G and a concentrated blue light when indicator arrow 7 is pointed towards blue indicator 8B. Thus color changer 1 and housing 2 each have indicators for locating each of the plurality of indexing positions.

Housing 2 also includes circuit 13 attached to the end of body 11 with an adhesive or other common fastening means.

Figure 4:
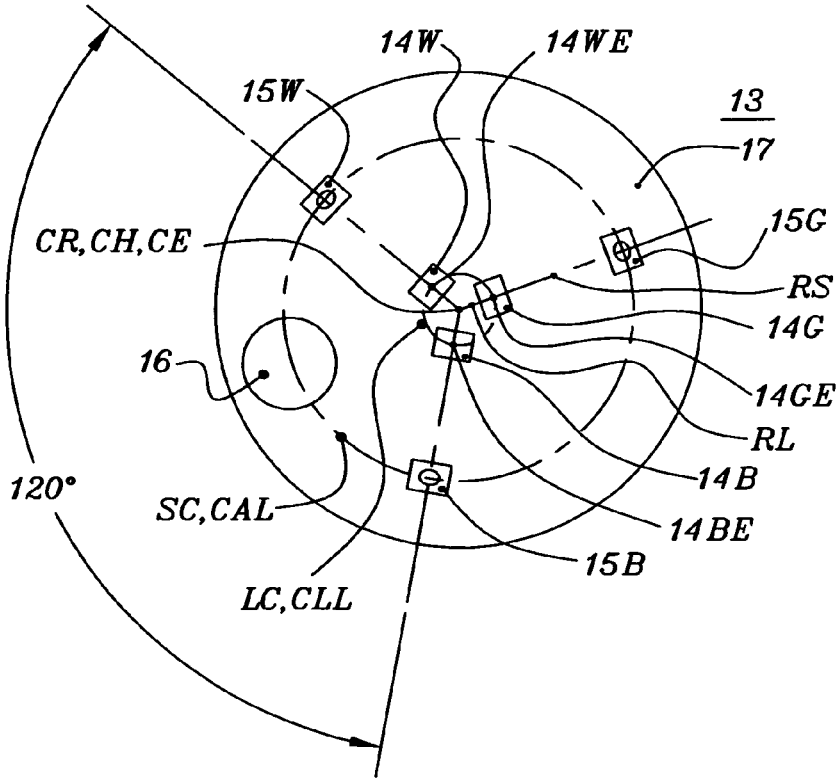

FIG. 4 shows a top view of circuit 13 removed from FIG. 2 and rotated. Circuit 13 comprises three led lamps or light sources each having an led emitter having a distinct colored light and each upon being connected to a power supply emitting its related distinct colored light. The three leds include white led 14W having white switch 15W, green led 14G having green switch 15G, blue led 14B having blue switch 15B and power supply 16 all attached to or mounted on printed circuit board 17. Power supply 16 is, for the present embodiment, a button type battery having a voltage of approximately 3 volts which is the voltage required to energize any of the three led light sources shown. Leds emitting colors distinct from those identified in the present embodiment including but not limited to red and infrared can be employed in this invention, however they may require the power supply to have a different voltage or require the addition of one or more resistors to circuit 13 configured according to standard design practices to meet the specification of each led light source.

Figure 5:
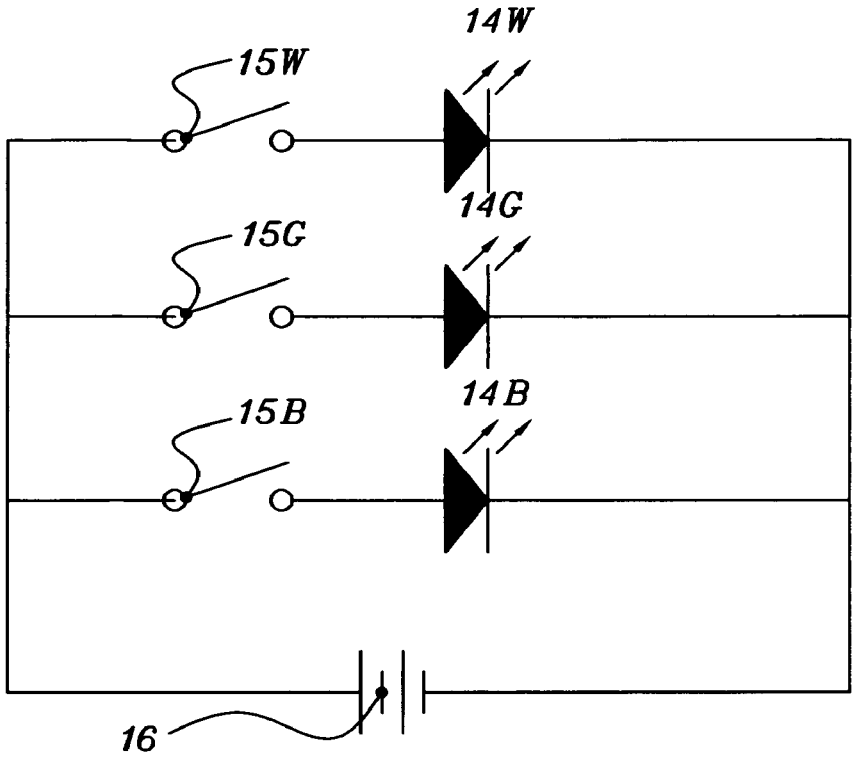
FIG. 5 is an electrical schematic of the circuit of the lighting device of FIG. 1

FIG. 5 is an electrical schematic of circuit 13. Circuit 13 is fabricated using conventional circuit traces—not shown—on printed circuit board 17. Each of the components of circuit 13 are surface mount components although other mounting systems can easily be employed. Surface mount led lamps are close to printed circuit board 17 and therefore can dissipate their heat more effectively than thru hole designs. Thus surface mount led lamps can be more efficient in the present design. Looking at the electrical schematic of FIG. 5 it can be seen that closing white switch 15W will energize white led 14W with power supply 16. Similarly closing green switch 15G will energize green led 14G and closing blue switch 15B will energize blue led 14B. Each of the switches are surface mounted momentary on push button switches. FIGS. 2, 3 and 4 show printed circuit board 17 as circular. White led 14W has white led emitter 14WE, green led 14G has green led emitter 14GE and blue led 14B has blue led emitter 14BE. Therefore lighting device 25 comprises three distinct colors however, any plurality of colors can be used. Each led emitter is placed on led radius RL and at an angular separation of 120 degrees on led circle LC centered at emitter centerline CE located at the center of printed circuit board 17. Each led has its related switch placed on printed circuit board 17 along the radius of its location on led circle LC but positioned on larger switch circle SC. It is beneficial for led circle LC to be larger than switch circle SC because this arrangement usually reduces the overall size of lighting device 25. This results because the switches can be located below catadioptric lens 3 without enlarging lighting device 25. In addition the large size of catadioptric lens 3 relative to switch activator 18 makes positioning lens centerline CL as close as possible to color changer centerline CR an important objective towards reducing the size of lighting device 25. The center of switch circle SC, the center of LED circle LC, emitter centerline CE and housing centerline CH are all coincident. Looking at FIG. 3 catadioptric lens 3 has focal point F which is the primary light concentrating point C. However there are numerous other light concentrating points near focal point F which will concentrate the light to create light beams of different shapes. An alternate light concentrating point not coincident with focal point F is acceptable if the resulting light beam is in conformance with a user's requirements. FIG. 3 shows switch activator 18 as a part of color changer 1 which in this embodiment is molded as an integral elongated member of catadioptric lens 3. Cover 6 is a transparent plastic cover of color changer 1. In the present embodiment catadioptric lens 3 and cover 6 are molded as one integral part attached to shell 4 with an adhesive. However they can be molded as separate components with catadioptric lens 3 attached to cover 6 with an adhesive and cover 6 is attached to shell 4 with an adhesive. Switch activator 18 is a cylindrical pin having switch activator centerline CA and a rounded tip permitting it to depress switches without damaging them.

Figure 6:
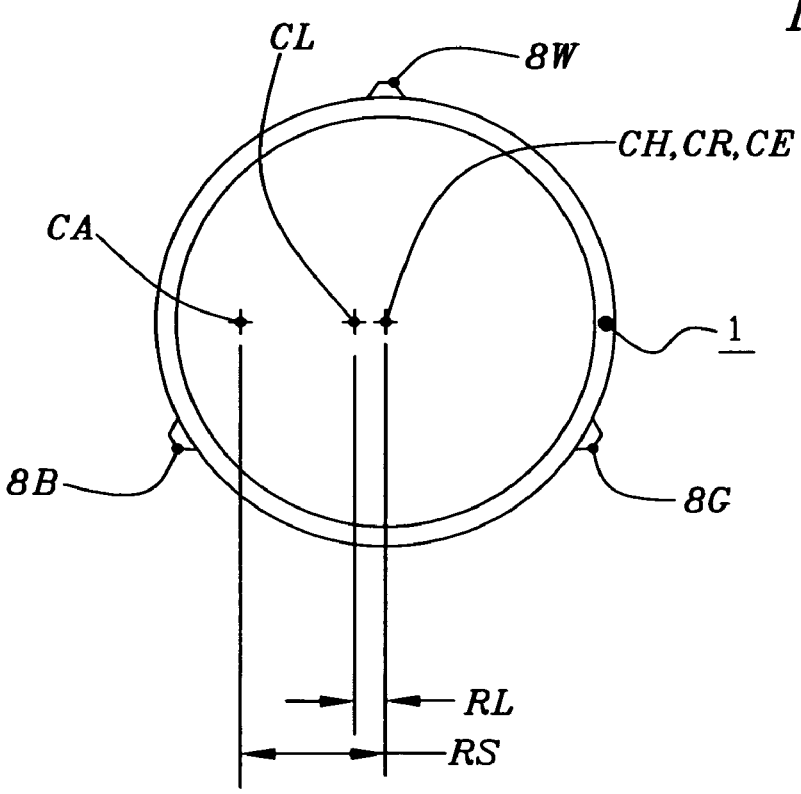
FIG. 6 is a top view of FIG. 3 with some invisible centerlines shown

FIG. 6 is a top view of FIG. 3. In FIG. 6 housing centerline CH, color changer centerline CR and emitter centerline CE are coincident and shown in FIG. 6 for diagrammatic reasons even though they are not normally visible in that view. Lens centerline CL is at distance led radius RL from housing centerline CH. Looking now at FIGS. 1, 3, 4 and 6 but primarily FIG. 4 as color changer 1 is rotated about housing 2 lens centerline CL moves along a circular lens centerline locus CLL which is coincident with led circle LC. As color changer 1 is rotated about housing 2 light concentration point C is moved and selectively disposed at each of the led emitters. Thus as color changer 1 is rotated about housing 2 each led emitter is disposed at a light concentrating position relative to catadioptric lens 3 at light concentrating point C where light it emits is concentrated towards parallelism with catadioptric lens centerline CL by catadioptric lens 3. Simultaneously and in a similar fashion as color changer 1 is rotated about housing 2 switch activator centerline CA moves along circular switch activator locus CAL which is coincident with switch circle SC. Thus as color changer 1 is rotated about housing 2 switch activator 18 is selectively disposed at a switch activation position relative to each switch where it depresses the switch to connect power supply 16 to its related led.

In FIGS. 1, 3 and 6 color changer 1 has been rotated about housing 2 such that arrow 7 aligns with white indicator 8W. This is the color changer indexing position for white led emitter 14WE. At this white led emitter 14WE indexing position of color changer 1 as seen in FIG. 1 white led emitter 14WE is disposed at white led emitter 14WE light concentrating position relative to catadioptric lens 3 at light concentrating point C which for the present embodiment of the present invention is at focal point F of catadioptric lens 3 to concentrate light emitted from white led emitter 14WE towards parallelism with catadioptric lens 3 centerline CL.

At white led 14W indexing position of color changer 1 white switch 15W is disposed at white switch activation position relative to color changer 1 with switch activator 18 depressing white switch 15W to connect and energize white led emitter 14WE with power supply 16. This is the switch activation position of white switch 15W for white led emitter 14WE where white switch 15W is effecting the connection of white led emitter 14WE to power supply 16 thereby energizing white led emitter 14WE to emit a distinct colored light. This system could also be described as color changer 1 effecting the connection of white led emitter 14WE to power supply 16. The light emitted by white led emitter 14WE is efficiently concentrated by catadioptric lens 3 to be brought towards parallelism with lens centerline CL to be projected from lighting device 25 as a concentrated light beam. White led emitter 14WE is shown at focal point F however it can be located at any light concentrating point which results in its emitted light being concentrated according to a user's specification requirement. Some specifications require an enlarged partially concentrated beam spread and for these specifications white led emitter 14WE is placed at a light concentrating point located at a small distance from focal point F.

As color changer 1 is rotated an additional 120 degrees arrow 7 becomes aligned with green indicator 8G. For the reasons already discussed at green led emitter 14GE indexing position green switch 15G is depressed by switch activator 18 to connect and energize green led 14G with power supply 16 causing it to emit green light which is concentrated by catadioptric lens 3 and projected from lighting device 25.

As color changer 1 is rotated further arrow 7 moves away from green indicator 8G and switch activator 18 moves away from green switch 15G deactivating or disconnecting green led 14G from power supply 16 and consequently de-energizing green led 14G. Additional rotation of color changer 1 aligns arrow 7 with blue indicator 8B. For reasons already discussed at blue led emitter 14BE indexing position blue switch 15B is depressed by switch activator 18 and closes circuit 13 to connect blue led 14B to power supply 16 causing blue led emitter 14BE to be energized and emit blue light which is efficiently concentrated by catadioptric lens 3. Looking at FIG. 1 if color changer 1 is rotated and positioned with arrow 7 aligned with off indicator 9 none of the switches are at their switch activation position and therefore lighting device 25 is off or de-energized in an off mode consuming no energy.

Color changer 1 has a plurality of indexing positions comprising an indexing position for each led emitter where arrow 7 on housing 2 aligns with the indicator for that led emitter, the led emitter is at the light concentrating focal point F of catadioptric lens 3 and the switch for the led emitter is activated connecting and energizing the led emitter with power supply 16. Color changer 1 is rotated for selective disposition of light concentrating point C at each of the plurality of led emitters to select from the plurality of available colors the distinct colored light to be concentrated and projected from lighting device 25. Color changer 1 is moved to a selected indexing position related to one led emitter to selectively emit from lighting device 25 the distinct colored light related to that led emitter selected from the plurality of colors available at different indexing positions and to position catadioptric lens 3 to concentrate and bring that light towards parallelism.

FIG. 7 is an enlarged diagrammatic view of catadioptric lens 3 and white led 14W removed from FIG. 3. FIG. 8 is a diagrammatic perspective view of a typical led similar to white led 14W and FIG. 9 is a cross-section taken across 9-9' of FIG. 8. FIGS. 8 and 9 show the construction of a typical commercially available ceramic body surface mount led having no lens. White led 14W of FIGS. 8 and 9 includes white led emitter 14WE which emits white light and is supported by white led base 14C. White led base 14C comprises a flat top base. Avoiding projections such as lenses or domes on the led base reduces the possibility that moving catadioptric lens 3 of the present invention will interfere with a projection and damage white led 14W. Features such as the electrical contact pads on the bottom of white led base 14C are not shown. White led emitter 14WE emits light into the hemisphere a range of light rays including forward light rays R and oblique rays RO. Catadioptric lens 3 concentrates light rays that it intersects and brings them towards parallelism with lens centerline CL forming a light beam which emerges from lighting device 25 from cover 6 as projected light beam P. Catadioptric lenses like catadioptric lens 3 are designed to maximize the percentage of emitted light which is being collected. In prior art designs the LED emitter is normally positioned within the lens so that all of its emitted light is collected into a concentrated light beam. In other prior art designs in which the led cannot fit into the lens clearance distance D, measured between lens base line B of catadioptric lens 3 and focal point F of catadioptric lens 3 as shown in FIG. 7, is minimized towards zero. This is done so that all emitted light rays which can be collected by catadioptric lens 3 are intersected and collected by catadioptric lens 3. It is possible that some of these prior art designs would include a small clearance distance D to prevent damage during assembly resulting from interference created by dimensional variations in components. This minimal clearance distance would not provide for movement between the catadioptric lens and each of the leds.

Looking at FIGS. 7, 8 and 9 we see that in the present invention with white led emitter 14WE at its light concentrating position and coincident with focal point F of catadioptric lens 3 there is clearance distance D between catadioptric lens 3 and white led 14W. This clearance distance is not desirable because oblique light rays RO emitted from white led emitter 14WE at oblique angles from white led axis 14WA are not intersected by catadioptric lens 3 and are lost. White led axis 14WA is the geometrical axis of the light emitted from white led 14W which comprises forward light rays R plus oblique light rays RO. In FIG. 9 white led axis 14W passes through the center of white led base 14WC. Catadioptric lens 3 which has a lateral movement relative to white led emitter 14WE is moved by color changer 1 so that lens centerline CL remains substantially parallel to white led axis 14WA. This is defined as lateral movement. Catadioptric lens 3 has a lateral movement relative to each of the led emitters in lighting device 25.

In the present invention clearance distance D is increased over prior art. This decreases the efficiency of the lighting device however in the present embodiment it is necessary because catadioptric lens 3 is rotated relative to each led including white led 14W of FIG. 7. If clearance distance D is not large enough to maintain a clearance during rotation of color changer 1 catadioptric lens 3 will catch on white led 14W and damage the circuit. Clearance distance D must be predetermined as large enough between white led emitter 14WE and lens base line B to avoid damage to all of the leds in the circuit taking into account the movement and flexing necessary to accommodate the rotating relationship that exists between color changer 1 and housing 2. Therefore in the present embodiment catadioptric lens 3 is contoured to establish focal point F or light concentration point C exterior to catadioptric lens 3 at predetermined clearance distance D away from lens base line B. The present invention prefers led lamps that do not have domes or projecting lenses as these projections would require an increase in clearance distance D which is normally not desirable.

The preferred embodiment of the present invention as shown in FIGS. 1 through 9 employs discrete led light sources including white led 14W, green led 14G and blue led 14B which are all flat top designs having no integral lenses. FIG. 10 is top view of plural color led 24 which includes plural white emitter 24WE, plural green emitter 24GE and plural blue emitter 24BE each positioned on plural led base 24C at a radial distance equal to led radius RL from plural led center PC and at an angular separation of 120 degrees. Plural led base 24C is physically similar to white led base 14WC in that both are rectangular in shape.

Looking back at FIG. 4 where the three led lights are at radial distance led radius RL from emitter centerline CE and at an angular separation of 120 degrees it can be seen that single plural color led 24 can be substituted for white led 14W, blue led 14B and green led 14G if plural led center PC is disposed coincident with housing centerline CH on printed circuit board 17. Therefore with proper placement of single plural color led 24 color changing lighting device 25 will function to emit any of three distinct colors upon proper color selection by indicator arrow 7. Using a single plural color led 24 in place of three discrete leds offers several advantages. The single plural color led 24 can be manufactured with the led radius RL greatly reduced. This beneficially reduces the size of lighting device 25. Also plural color led 24 comprises all of its led emitters on single flat top plural led base 24C avoiding the variations in height and location relating to three separate leds which can interfere with color changer 1 as it moves.

Although the description above contains many specificities, these should not be construed as limiting the scope of the invention but as merely providing illustrations of some of the presently preferred embodiments of this invention. For example preferred embodiment power supply 16 is a lithium 3 volt printed circuit board mounted coin cell battery. However the present invention can function well with other battery types including those positioned within an elongated version of housing 2 in a fashion similar to a flashlight. Also power supply 16 need not be a battery, it can be a capacitor or an external power supply. Also in the preferred embodiment switches 15W, 15G and 15B are surface mount momentary on switches activated by switch activator 18 an integral part of catadioptric lens 3. However one skilled in the art can employ other switch types and other switch activator designs to employ the concepts of the present invention. In this regard hall effect switches activated by a magnet can also be employed in the present invention. Also in place of a discrete switch for each led emitter a single switch with multiple contacts or a single switch with a sensing circuit can activate a plurality of led emitters.

Also in the preferred embodiment of the present invention color changer 1 is rotated to an indexing position for each of the plurality of LED emitters where arrow 7 aligns with an indicator for the related led emitter. This rotation also moves light concentrating point C of catadioptric lens 3 such that each led emitter is at its light concentrating position. Arrow 7 is part of a visual indicator system, however since each led emitter is illuminated as its switch is activated by color changer 1 as color changer 1 is moved to its indexing position it is possible to use the illumination of the led emitter as the visual indicator and not require indicator arrow 7 or indicators 8W, 8G or 8B. Using the illumination of each led emitter to locate the indexing position of color changer 1 related to that led emitter would reduce the complexity and cost of the current invention. Alternatively a variety of common spring loaded catch designs can also be used as non-visual indicators to locate the indexing positions to employ the concepts of the present invention.

Also although in the present embodiment color changer 1 activates the switches to energize each of the plurality of led emitters it is possible to construct a device using the concepts of the present invention in which each of the led emitters are constantly connected to power supply 16 and each emitting their distinct colored light. Also the led emitters could be connected to power supply 16 manually or by using an auxiliary device such as a component of a machine. In the above designs after an led emitter was energized color changer 1 would be moved to concentrate and project the distinct color of light emitted by that led element Finally the preferred embodiment employs a rotating movement of color changer 1 comprising an equal angular magnitude of movement between indexing positions. Other movements having a variety of contours can also be used to employ the concepts of the present invention.

Thus the scope of the invention should be determined by the appended claims and their legal equivalents rather than by the examples given.

I claim:

1. A color changing lighting device comprising;

a color changer moveably attached to a housing and having a plurality of indexing positions relative to said housing, said color changer including a switch activator and a light concentrating optic employing a reflector and a refractor for concentrating and projecting from said lighting device light emitted at a light concentrating point of said optic;

said housing having a circuit comprising a plurality of LED emitters having a plurality of colors of light, each of said plurality of LED emitters having a related switch and emitting a distinct colored light upon being connected to a power supply; and each of said plurality of LED emitters having an indexing position of said color changer for selective disposition at said light concentrating point and connection to said power supply by selective disposition of said switch activator activating the related switch of said circuit whereby said color changer can be used to select from said plurality of colors of light the distinct colored light to be concentrated and projected from said lighting device.

2. A color changing lighting device according to claim 1 which further includes;

each of said plurality of LED emitters having the related switch comprising a push button switch for connection to said power supply.

3. A color changing lighting device according to claim 1 which further includes;

said switch activator and the related switch of each of said plurality of LED emitters disposed at an equal distance from a centerline of said color changer.

4. A color changing lighting device according to claim 3 which further includes;

said power supply comprising a battery within said lighting device.

5. A color changing lighting device according to claim 4 which further includes;

a plural color LED having said plurality of LED emitters.

6. A color changing lighting device according to claim 5 which further includes;

a predetermined distance between each of said plurality of LED emitters and a base line of said optic for unencumbered lateral movement between each of said plurality of LED emitters and said optic.

7. A color changing lighting device according to claim 6 wherein;

said optic further concentrates the light towards parallelism with a centerline of said optic.

8. A color changing lighting device according to claim 1 which further includes: a flat top base for each of said plurality of LED emitters.

9. A color changing lighting device according to claim 8 which further includes;

said plurality of LED emitters positioned on an LED circle, and the related switch of each of said plurality of LED emitters positioned on a switch circle concentric with said LED circle; and said switch circle larger than said LED circle.

10. A color changing lighting device according to claim 9 which further includes;

the indexing position of each of said plurality of LED emitters having an indicator on said color changer for alignment with a housing indicator indicating said indexing position.

11. A color changing lighting device according to claim 10 which further includes;

said color changer having an indexing position on an exterior of said color changer for indicating said lighting device as de-energized.

12. A color changing lighting device according to claim 4 which further includes;

said light concentrating point exterior to said optic and interior to said lighting device.

13. A color changing lighting device comprising;

a color changer moveably attached to a housing and having a plurality of indexing positions relative to said housing, said color changer including a switch activator and a light concentrating molded catadioptric lens for concentrating and projecting from said lighting device light emitted at a light concentrating point of said lens;

said housing having a circuit comprising a plurality of LED emitters having a plurality of colors of light, each of said plurality of LED emitters having a related switch and emitting a distinct colored light upon being connected to a power supply; and each of said plurality of LED emitters having an indexing position of said color changer for selective disposition at said light concentrating point and connection to said power supply by selective disposition of said switch activator activating the related switch of said circuit whereby said color changer can be used to select from said plurality of colors of light the distinct colored light to be concentrated and projected from said lighting device.

14. A color changing lighting device according to claim 13 which further includes;

each of said plurality of LED emitters having the related switch comprising a push button switch.

15. A color changing lighting device according to claim 13 which further includes;

said power supply comprising a battery within said lighting device.

16. A color changing lighting device according to claim 13 which further includes;

a plural color LED having said plurality of LED emitters.

17. A color changing lighting device according to claim 13 which further includes;

a predetermined clearance distance between each of said plurality of LED emitters and a lens base line of said lens for permitting unencumbered relative lateral movement between each of said plurality of LED emitters and said lens.

18. A color changing lighting device according to claim 13 which further includes;

said light concentrating point exterior to said lens and interior to said lighting device.

19. A color changing lighting device according to claim 13 which further includes;

a flat top base for each of said plurality of LED emitters.

20. A color changing lighting device according to claim 13 which further includes;

said plurality of LED emitters substantially positioned on an LED circle and the related switch of each of said plurality of LED emitters substantially positioned on a switch circle concentric with said LED circle; and said switch circle larger than said LED circle.

21. A color changing lighting device comprising;

a color changer moveably attached to a housing, said color changer including a catadioptric light concentrating lens for concentrating for projection from said lighting device light emitted at a light concentrating point of said lens, said light concentrating point exterior to said lens at a clearance distance from a lens base line;

said housing having a circuit comprising a plurality of LED emitters having a plurality of colors of light, each of said plurality of LED emitters emitting a distinct colored light upon being connected to a power supply, said lens disposed at a predetermined distance from said plurality of LED emitters for unencumbered movement between said lens and each of said plurality of LED emitters; and each of said plurality of LED emitters having an indexing position of said color changer for selective disposition at said light concentrating point whereby upon being connected to said power supply the distinct colored light is concentrated and projected from said lighting device.

22. A color changing lighting device according to claim 21 which further includes;

said power supply comprising a battery within said lighting device.

23. A color changing lighting device according to claim 21 which further includes;

a plural color LED having said plurality of LED emitters.

24. A color changing lighting device according to claim 21 which further includes;

a flat top base for each of said plurality of LED emitters.

25. A color changing lighting device according to claim 21 which further includes;

said color changer having a rotational movement relative to said housing.

26. A color changing lighting device according to claim 21 which further includes;

each of said plurality of LED emitters substantially positioned on an LED circle and having a related switch for connection to said power supply substantially positioned on a switch circle, said switch circle concentric with said LED circle; and said switch circle larger than said LED circle.

27. A color changing lighting device according to claim 21 which further includes;

said light concentrating point exterior to said lens and interior to said lighting device.

28. A color changing lighting device comprising;

a color changer rotatably attached to a housing, said color changer including a catadioptric light concentrating lens for concentrating for projection from said lighting device light emitted at a light concentrating point of said lens;

said color changer having a centerline at a distance from said light concentrating point of said lens;

said housing having a circuit comprising a plurality of LED emitters positioned on an LED circle centered about said centerline and having a plurality of colors of light, each of said plurality of LED emitters emitting a distinct colored light upon being connected to a power supply; and each of said plurality of LED emitters having an indexing position of said color changer for selective disposition at said light concentrating point whereby upon being connected to said power supply a selected color of light of said plurality of colors of light is concentrated and projected from said lighting device.

29. A color changing lighting device according to claim 28 which further includes;

said power supply comprising a battery within said lighting device.

30. A color changing lighting device according to claim 28 which further includes;

a plural color LED having said plurality of LED emitters.

31. A color changing lighting device according to claim 28 which further includes;

a flat top base for each of said plurality of LED emitters.

32. A color changing lighting device according to claim 28 which further includes;

said color changer having a rotational movement relative to said housing.

33. A color changing lighting device according to claim 28 which further includes;

each of said plurality of LED emitters having a related switch for connection to said power supply substantially positioned on a switch circle, said switch circle concentric with said LED circle; and said switch circle larger than said LED circle.

34. A color changing lighting device according to claim 28 which further includes;

said light concentrating point exterior to said lens and interior to said lighting device.

35. A color changing lighting device comprising;

a plurality of LED emitters attached to a housing and having a plurality of colors of light; each of said plurality of LED emitters emitting a distinct colored light upon being connected to a power supply and each upon being positioned at a light concentrating point of a light concentrating catadioptric lens having said distinct colored light concentrated for projection from said lighting device; and a color changer means for each of said plurality of LED emitters for selective disposition at said light concentrating point and connection to said power supply whereby said color changer means can be used to select the distinct colored light to be concentrated for projection from said lighting device.

36. A color changing lighting device comprising:

a plurality of LED emitters having a plurality of colors and attached to a housing, each of said plurality of LED emitters upon being connected to a power supply emitting a distinct colored light and upon being positioned at a light concentrating point of a catadioptric lens having said distinct colored light concentrated and projected by said lens; and a color changer moveably connected to said housing and comprising said lens, said lens having a substantially lateral movement relative to said plurality of LED emitters for selective disposition of said light concentrating point at each of said plurality of LED emitters whereby said color changer can, upon each of said plurality of LED emitters being connected to said power supply, be used to concentrate and project from said lighting device the distinct colored light of each of said plurality of LED emitters.

37. A color changing lighting device comprising:

a housing comprising a circuit, said circuit including a plurality of LED emitters having a plurality of colors of light and a plurality of switches;

a color changer comprising a switch activator and a catadioptric lens for concentrating light towards parallelism, said color changer moveably attached to said housing; and each of said plurality of LED emitters having a related switch and upon being connected to a power supply emitting a distinct colored light, each having a light concentrating position relative to said lens for said distinct colored light being concentrated by said lens, each having a switch activation position for said switch activator activating the related switch for connection to said power supply, each having an indexing position of said color changer relative to said housing, each upon said color changer being positioned at said indexing position disposed at said light concentrating position and at said switch activation position for emitting said distinct colored light concentrated by said lens towards parallelism whereby said color changer can be used to select from said plurality of colors of light the distinct colored light concentrated by said lighting device.

38. A method for concentrating and projecting from a color changing lighting device a colored light selected from a plurality of colors of light, comprising the steps of:

(a) providing a color changer moveably attached to a housing and having a plurality of positions relative to said housing, said color changer including a switch activator and a light concentrating catadioptric lens for concentrating and projecting from said lighting device light emitted at a light concentrating point of said lens, said light concentrating point exterior to said lens and at a clearance distance from the lens; said housing having a circuit comprising a plurality of LED emitters having said plurality of colors of light, each of said plurality of LED emitters emitting a distinct colored light upon being connected to a power supply, each of said plurality of LED emitters having an indexing position of said color changer for selective disposition at said light concentrating point and for selective disposition of said switch activator at a switch of said circuit for connection to said power supply; and (b) selectively moving said color changer to the indexing position of one of said plurality of LED emitters whereby said color changer is used to select one of said plurality of colors of light to be concentrated and projected from said lighting device.

39. A method of concentrating for projection from a color changing lighting device a colored light selected from a plurality of colors of light, comprising the steps of:

(a) providing a plural color LED having a plurality of LED emitters, said plurality of LED emitters having a plurality of colors of light and attached to a housing, each of said plurality of LED emitters upon being connected to a power supply emitting a distinct colored light and upon being positioned at a light concentrating point of a catadioptric lens having said distinct colored light concentrated and projected by said lens, and a color changer moveably connected to said housing and comprising said lens, said lens having a substantially lateral movement relative to said plurality of LED emitters for selectively positioning said light concentrating point at each of said plurality of LED emitters, and (b) selectively moving said color changer and positioning said light concentrating point at each of said plurality of LED emitters whereby upon each of said LED emitters being connected to said power supply, said lens concentrates and projects a selected color of light from said plurality of colors of light to be concentrated and projected by said lens.

* * * * *